US007778587B2

(12) United States Patent
Shoji

(10) Patent No.: US 7,778,587 B2
(45) Date of Patent: Aug. 17, 2010

(54) AUTO DOCUMENT FEEDER

(75) Inventor: Naoki Shoji, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/266,256

(22) Filed: Nov. 6, 2008

(65) Prior Publication Data

US 2009/0074489 A1 Mar. 19, 2009

Related U.S. Application Data

(62) Division of application No. 11/440,653, filed on May 24, 2006, now Pat. No. 7,466,956.

(30) Foreign Application Priority Data

Jul. 8, 2005 (JP) ..... 2005-200449

(51) Int. Cl.
*G03G 15/00* (2006.01)

(52) U.S. Cl. ..... 399/367; 399/368; 399/369; 399/370; 399/371; 399/372; 399/373; 399/374; 399/375

(58) Field of Classification Search ..... 399/367, 399/368, 369, 370, 371, 372, 373, 374, 375
See application file for complete search history.

(56) References Cited

U.S. PATENT DOCUMENTS 7,038,819 B2 5/2006 Fang et al.
2005/0163546 A1* 7/2005 Kim ..... 399/367
2005/0195450 A1 9/2005 Shoji
2005/0201786 A1 9/2005 Ito

FOREIGN PATENT DOCUMENTS

| | | |
|---|---|---|
| CN | 1429007 | 8/2005 |
| JP | 09-027889 | 1/1997 |
| JP | 2003-174541 | 6/2003 |
| JP | 2003-189069 | 7/2003 |
| JP | 2004-256229 | 9/2004 |

OTHER PUBLICATIONS

Chines Office Action mailed Oct. 31, 2008 corresponding to U.S. Appl. No. 12/266,256, filed on Nov. 6, 2008.
Japanese Office Action for 2005-200449 mailed on Nov. 10, 2009.

* cited by examiner

*Primary Examiner*—Judy Nguyen
*Assistant Examiner*—Andy L Pham
(74) *Attorney, Agent, or Firm*—Turocy & Watson, LLP

(57) ABSTRACT

An auto document feeder which loads and feeds a document to a read position provided on a read surface of a reader, the auto document feeder including a conveying device having an upstream roller placed upstream of the read position and a downstream roller placed downstream of the read position, the conveying device conveying the loaded document through the read position, a stabilizing roller provided upstream of the read position and opposing to the read surface, the stabilizing roller stabilizing movement of the document conveyed by the conveying device, and a guide member provided downstream of the read position and opposing to the read surface, the guide member guiding the document conveyed by the conveying device, wherein the following relationship is established the thickness of the document<a gap between the read surface and the stabilizing roller<a gap between the read surface and the guide member.

6 Claims, 3 Drawing Sheets

AUTO DOCUMENT FEEDER

CROSS-REFERENCE TO RELATED APPLICATIONS

This application claims the benefit of priority from and is a division of application Ser. No. 11/440,653 filed on May 24, 2006, which is based upon and claims the benefit of priority from prior Japanese Patent Application No. 2005-200449, filed Jul. 8, 2005, the entire contents of both of which are incorporated herein by reference.

BACKGROUND OF THE INVENTION

1. Field of the Invention

The present invention relates to an auto document feeder that supplies each of a plurality of documents to a predetermined read position, the document feeder being used in a digital copier or the like which copies an image from a document or the like to a sheet.

2. Description of the Related Art

Image forming apparatuses such as digital copiers are provided with an auto document feeder (ADF) based on what is called a sheet through scheme; the auto document feeder loads and conveys each document to a read position in a document reader.

In an image forming apparatus provided with the auto document feeder based on the sheet-through scheme, a glass plate (read surface) is provided at a read position in the document reader. An image is read from a document being conveyed, through the glass plate.

The auto document feeder based on the sheet-through scheme comprises a plurality of conveying rollers that convey a loaded document, stabilizing roller located at the read position of the glass plate to stabilize the behavior of the document, and guide member placed upstream of the read position of the glass plate to guide the document along a glass surface.

As a technique relating to the sheet-through scheme, an image reader has been disclosed which has a specified spacing between a backup roller and contact glass (see, for example, Jpn. Pat. Appln. KOKAI Publication No. 9-27889).

It is known that, with the auto document feeder based on the sheet-through scheme, the quality of a read image is affected by the spacings between the glass plate and the stabilizing roller and between the glass plate and the guide member. It is also known that, particularly with a color copier, these spacings significantly affect the quality of the read image. However, in conventional auto document feeders, these spacings are not optimized, thus disadvantageously preventing sufficient image quality from being achieved.

BRIEF SUMMARY OF THE INVENTION

The present invention provides an auto document feeder that improves the quality of an image read from a document by an image reader.

An aspect of the present invention configures the auto document feeder as described below.

An auto document feeder which loads and feeds a document to a read position provided on a read surface of a reader comprises a conveying device including an upstream roller placed upstream of the read position and a downstream roller placed downstream of the read position, the conveying device conveying the loaded document through the read position; a stabilizing roller provided upstream of the read position and opposing to the read surface, the stabilizing roller stabilizing movement of the document conveyed by the conveying device; and a guide member provided downstream of the read position and opposing to the read surface, the guide member guiding the document conveyed by the conveying device. The following relationship is established: the thickness of the document<a gap between the read surface and the stabilizing roller<a gap between the read surface and the guide member.

The present invention improves the quality of an image read from a document by an image reader.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described below in detail with reference to the drawings.

(Configuration of a Digital Copier)

Figure 1:
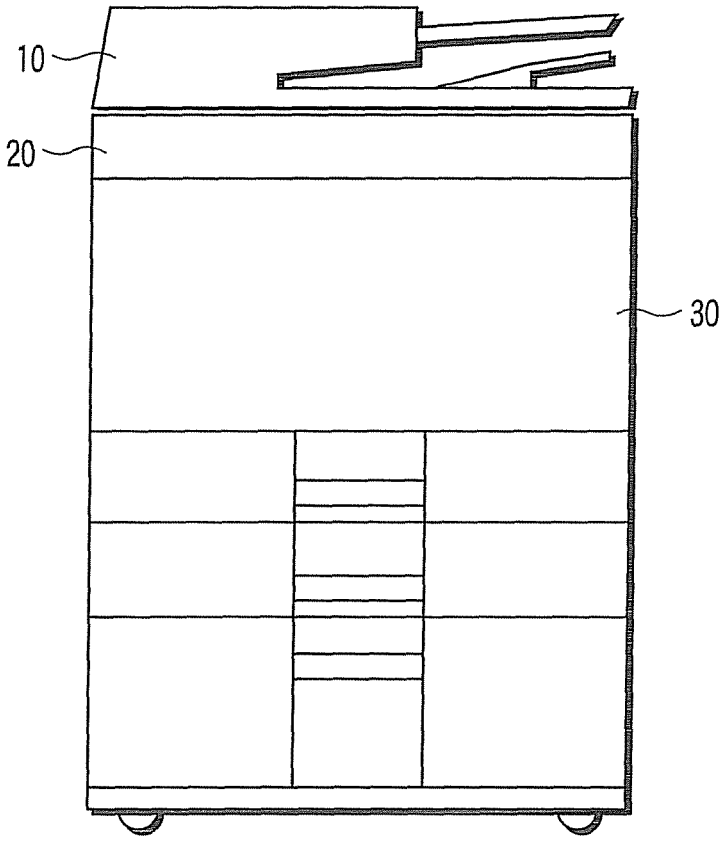
FIG. 1 is a front view showing a digital copier according to an embodiment of the present invention.

FIG. 1 is a front view showing a digital copier according to an embodiment of the present invention. As shown in FIG. 1, the digital copier comprises an auto document feeder (ADF) 10, a scanner unit 20, and a printer engine section 30.

The auto document feeder 10 is supported on a top surface of the scanner unit 20 so as to be rotatively movable around a shaft placed on one side of the scanner unit 20 in a horizontal direction. The auto document feeder 10 loads and supplies each document D to a read position R (described later).

The scanner unit 20 optically reads an image from the document D supplied by the auto document feeder 10 or manually to convert the image into image data.

The printer engine section 30 comprises a charger, a laser unit, a photosensitive drum, a developing device, a transfer roller, and a fixing device (none of them are shown). The charger charges a surface of the photosensitive drum to a predetermined potential. The laser unit forms an electrostatic latent image on the surface of the photosensitive drum on the basis of image data from the scanner unit 20. The developing device develops the electrostatic latent image on the photosensitive drum using toner. The transfer roller transfers the toner image formed on the photosensitive drum to a sheet. The fixing device fixes the toner image transferred to the sheet. In this configuration, the printer engine section 30 copies the document image read by the scanner unit 20 to the sheet.

(Configuration of the Auto Document Feeder 10)

Figure 3:
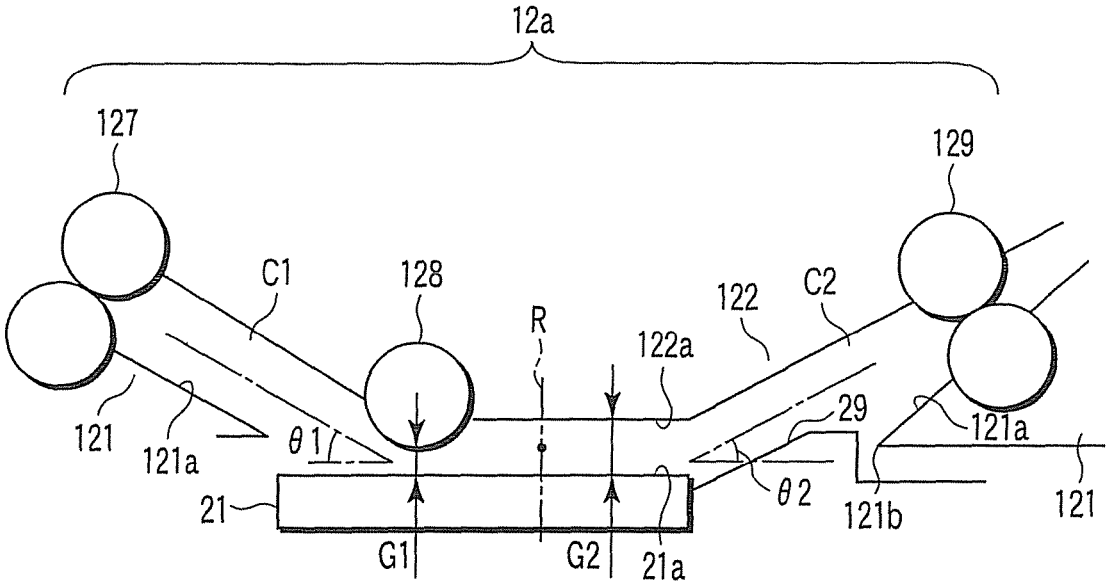
FIG. 3 is an enlarged sectional view of the structure of the auto document feeder and scanner unit according to the embodiment of the present invention which is located around a read position.
Figure 2:
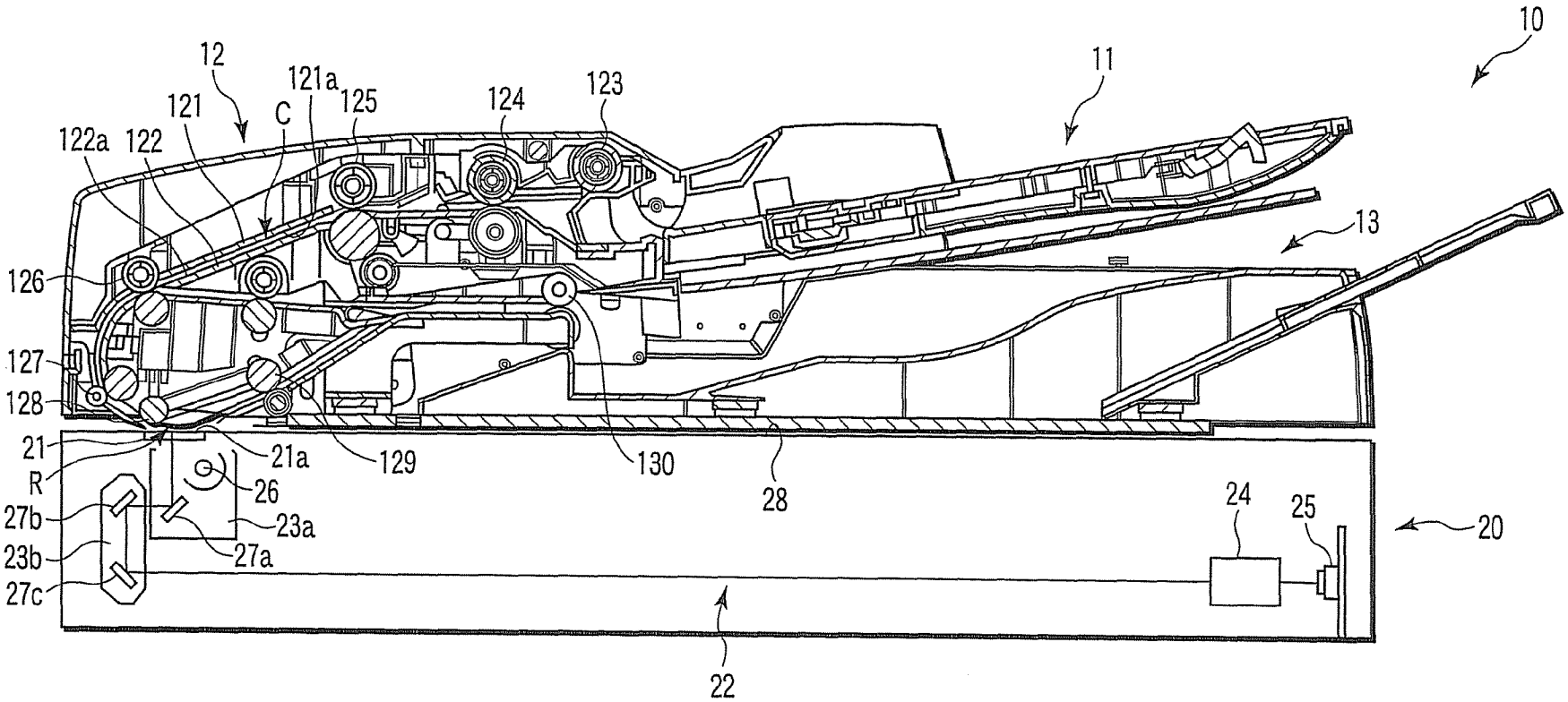
FIG. 2 is a sectional view showing the internal structure of an auto document feeder and a scanner unit according to the embodiment of the present invention.

FIG. 2 is a sectional view showing the internal structure of the auto document feeder 10 and scanner unit 20 according to the embodiment of the present invention. FIG. 3 is an enlarged sectional view of the structure of the auto document feeder 10 and scanner unit 20 according to the embodiment of the present invention which is located around the read position R.

As shown in FIGS. 2 and 3, the auto document feeder 10 is composed of a sheet feeding tray 11 on which a plurality of documents D are placed, a conveying device 12 that takes each of the documents D out of the sheet feeding tray 11 to convey the document D along a conveying path C (described later), and a sheet discharging tray 13 that accommodates a plurality of documents D discharged by the conveying device 12.

The conveying device 12 comprises a first and second guide members 121 and 122. The first and second guide members 121 and 122 comprise smooth guide surfaces 121*a* and 122*a*, respectively. The conveying path C is provided in the gap between the guide surfaces 121*a* and 122*a* so that the document D can be conveyed along the conveying path C.

The conveying path C connects the sheet feeding tray 11 and the sheet discharging tray 13 together. The read position R is provided in a portion of the conveying path C which is closest to the scanner unit 20; a document image is read at the read position R.

The conveying path C comprises an entry portion C1 located upstream of the read position R to allow the document D to reach the read position R, and an exit portion C2 located downstream of the read position R to allow the document D to leave the read position R.

The entry and exit portions C1 and C2 are inclined at angles θ1 and θ2, respectively, to a read surface 21*a* of a glass plate 21 (described later). This causes the conveyed document D to obliquely approach and leave the read position R.

The angles θ1 and θ2 are not particularly limited. However, the inventor's experiments indicate that the behavior of the document D passing through the read position R is most stable when the angles θ1 and θ2 are about 35 and 40 degrees, respectively.

The first guide member 121 is placed outside the second guide member 122. The first guide member 121 has a rectangular opening 121*b* formed in its area corresponding to the read position R. This allows the document D conveyed along the conveying path C to be located opposite the scanner unit 20 on passing through the read position R.

The second guide member 122 lies, in its area corresponding to the read position R, opposite the scanner unit 20 through the opening 121*b* in the first guide member 121. A gap (described later) is formed between the second guide member 122 and the read surface 21*a* of the glass plate 21 (described later) so that the document D can be conveyed through the gap.

The conveying path C has a pickup roller 123, a separate roller 124, a registration roller 125, a first conveying roller 126, a second conveying roller (upstream roller) 127, a stabilizing roller 128, a third conveying roller (downstream roller) 129, and a sheet discharging roller 130 which are arranged in this order from an upstream side in a direction in which the document D is conveyed.

The pickup roller 123 picks up each of the documents D in the sheet feeding tray 11 and loads it into the conveying path C of the conveying device 12. When a plurality of documents D are loaded by the pickup roller 123, the separate roller 124 passes only the uppermost document D through, while blocking the advancement of the remaining documents D. The registration roller 125 registers the document D the advancement of which is not blocked by the separate roller 124. The first to third conveying rollers 126, 127, and 129 convey the document D registered by the registration roller 125, along the conveying path C. The second and third conveying rollers 127 and 129 are located upstream and downstream, respectively, of the read position R, that is, in the entry and exit portions C1 and C2, respectively, of the conveying path C. The second and third conveying rollers 127 and 129 constitute a passing device (conveying device) 12*a* that conveys and passes the document D through the read position R. The stabilizing roller 128 is located upstream of the read position R and opposite the read surface 21*a* of the glass plate 21. The stabilizing roller 128 stabilizes the behavior of the document D conveyed by the first to third conveying rollers 126, 127, and 129. The stabilizing roller 128 rotates at substantially the same speed as that at which the document D is conveyed. The stabilizing roller 128 has a small friction coefficient. A gap (described later) is formed between the stabilizing roller 128 and the read surface 21*a* of the glass plate 21 so that the document D can be conveyed through the gap. The sheet discharging roller 130 discharges the document D conveyed by the first to third conveying rollers 126, 127, and 129, from the conveying path C.

Each of the rollers 123 to 128 has a plurality of (in the present embodiment, four) roller pieces around a horizontally supported drive shaft at predetermined intervals. When each of the drive shafts is rotated, all roller pieces provided around the drive shaft rotate concurrently.

The separate roller 124, the registration roller 125, the first conveying roller 126, the second conveying roller 127, the third conveying roller 129, and the sheet discharging roller constitute respective roller pairs together with driven rollers arranged opposite them across the conveying path C. For example, the separate roller 124 constitutes a separate roller pair together with a corresponding driven roller.

(Configuration of the Scanner Unit 20)

As shown in FIG. 2, the scanner unit 20 comprises the glass plate 21 at a position corresponding to the read position R when the auto document feeder 10 overlaps the scanner unit 20. The glass plate 21 is colorless and transparent, and its top surface functions as the read surface 21*a*, on which an image is read from the document.

A reader 22 is provided inside the scanner unit 20 to read an image from the document D passing through the read position R. The reader 22 comprises a first carriage 23*a*, a second carriage 23*b*, an image forming lens 24, and a CCD sensor 25.

The first carriage 23*a* is provided with an exposure lamp 26 that irradiates the document D passing on the read surface 21*a* of the glass plate 21, and a first mirror 27*a* that reflects reflected light from the document surface in a predetermined direction. Second and third mirrors 27*b* and 27*c* are attached to the second carriage 23*b* to reflect the reflected light from the first mirror 27*a* in a predetermined direction.

The light emitted from the exposure lamp 26 passes through the glass plate 21 to the document D passing through the read position R. The light having reached the document D is reflected off the document surface of the document D. The light then passes through the glass plate 21 back to the scanner unit 20. The light having returned to the scanner unit 20 is reflected by the first to third mirrors 27*a* to 27*c* and then converged by the image forming lens 24. The light converged by the image forming lens 24 is detected by the CCD sensor 25. The detection signal is used to create image data.

A document glass board 28 is provided on the top surface of the scanner unit 20 so that the document D is manually placed on the document glass board 28. The document glass board 28 is used to read a document image without the use of the auto document feeder 10.

A scooping surface 29 (shown only in FIG. 3) is provided on the top surface of the scanner unit 20 upstream of the read position R at a position corresponding to the opening 121*b* in the first guide member 121. The scooping surface 29 scoops up a leading end of the document D having passed through the read position R to guide the document D to the exit portion C2 of the conveying path C.

(Conveying Path C Around the Read Position R)

As shown in FIG. 3, the present embodiment establishes the following relationship between the thickness T (not shown) of the document D, the gap G1 between the read surface 21*a* of the glass plate 21 and the stabilizing roller 128, and the gap G2 between the read surface 21*a* of the glass plate 21 and a guide surface 122*a* of the second guide member 122: document thickness T<gap G1<gap G2.

The present embodiment sets the gaps G1 and G2 larger than the thickness T of the document D. This prevents the conveyed document D from being caught in the gap between the stabilizing roller 128 and the read surface 21*a* or in the gap between the second guide member 122 and the read surface 21*a*. The document D thus passes smoothly through the read position R.

The present embodiment also sets the gap G2 larger than the gap G1. This allows the document D having passed through the read position R to move smoothly to the exit portion C2 of the conveying path C (that is, obliquely upward) without being obstructed by the second guide member 122.

(Support Structure for the Stabilizing Roller 128)

Figure 4:
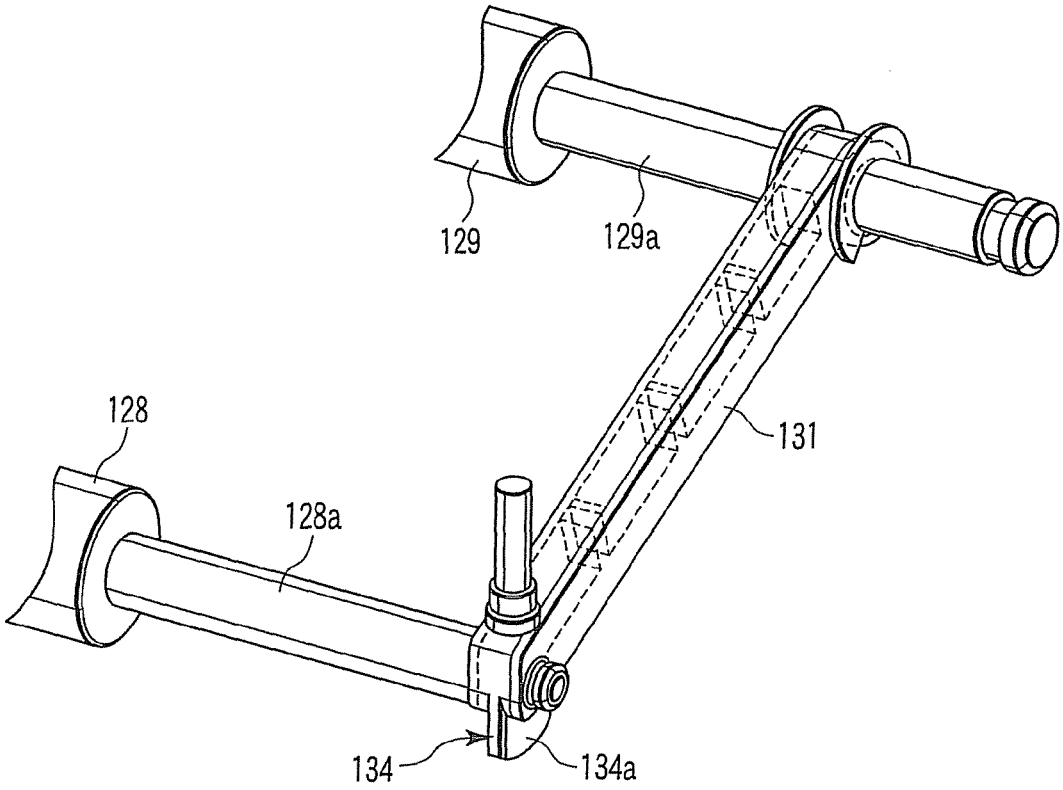
FIG. 4 is a perspective view showing a support structure for a stabilizing roller according to the embodiment.
Figure 5:
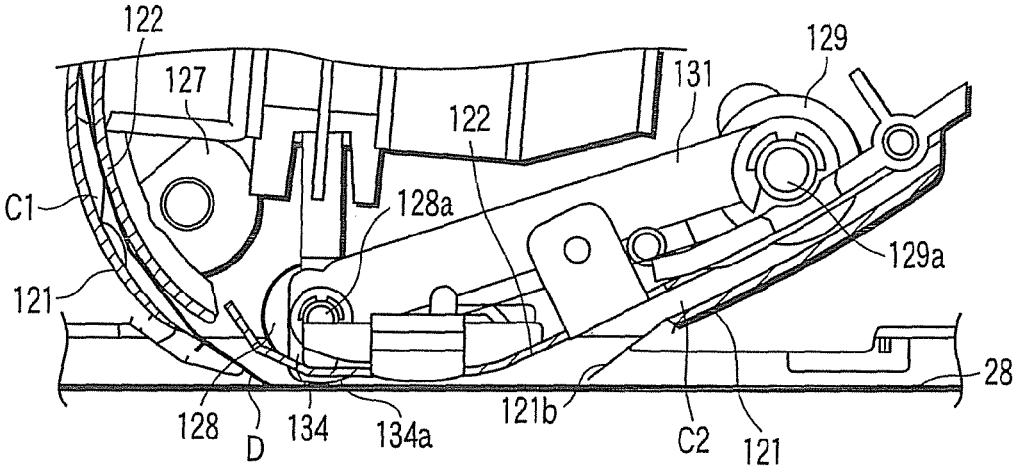
FIG. 5 is a front view showing the support structure for the stabilizing roller according to the embodiment.

FIG. 4 is a perspective view showing a support structure for the stabilizing roller 128 according to the embodiment. FIG. 5 is a front view showing the support structure for the stabilizing roller 128 according to the embodiment.

As shown in FIGS. 4 and 5, a drive shaft (first shaft) 128*a* of the stabilizing roller 128 is connected to a drive shaft (second shaft) 129*a* of the third conveying roller 129 via support members 131 (only one of them is shown) disposed on the opposite sides of each roller in a longitudinal direction.

Each support member 131 has insertion holes at its opposite ends into which the drive shaft 128*a* of the stabilizing roller 128 and the drive shaft 129*a* of the third conveying roller 129 are rotatably inserted respectively. This allows the stabilizing roller 128 to be supported so as to be rotatable around the drive shaft 129*a* of the third conveying roller 129.

The material of the support member 131 is, for example, polyacetal, which has a high slidability. Thus, even if the drive shaft 128*a* rubs against the support member 131 as the stabilizing roller 128 rotates, the drive shaft 128*a* and the support member 131 are prevented from being worn or heated.

A projecting portion 134 is provided at the end of the support member 131 which corresponds to the stabilizing roller 128. With the auto document feeder 10 lowered, the projecting portion 134 projects toward the document glass board 28 of the scanner unit 20. A circular surface (curved surface) 134*a* is formed on an end surface lying opposite the document glass board 28.

The circular surface 134*a* comprises a center of curvature on the axis of the drive shaft 128*a* of the stabilizing roller 128. The circular surface 134*a* has a radius of curvature larger than the radius of the stabilizing roller 128 by an amount corresponding to the gap G1.

Thus, when the auto document feeder 10 overlaps the document glass board 28, the projecting portion 134 abuts against the document glass board 28 to form the gap G1 between the stabilizing roller 128 and the read surface 21*a* of the glass plate 21.

Effects of the Present Embodiment

The present embodiment establishes the following relationship between the document thickness T, the gap G1 between the read surface 21*a* of the glass plate 21 and the stabilizing roller 128, and the gap G2 between the read surface 21*a* of the glass plate 21 and the guide surface 122*a* of the second guide member 122: document thickness T<gap G1<gap G2.

Thus, the conveyed document D passes smoothly through the read position R without being stopped in the gap between the read surface 21*a* of the glass plate 21 and the stabilizing roller 128 or in the gap between the read surface 21*a* of the glass plate 21 and the second guide member 122. This stabilizes the behavior of the document D at the read position R to improve the quality of the document image read by the reader 22.

In the present embodiment, the gap G1 is determined because the circular surface 134*a* of the projecting portion 134 abuts against the document glass board 28. Thus, the gap G1 meets the above relationship simply by lowering the auto document feeder 10 so that it overlaps the scanner unit 20. This eliminates the need for periodic adjustment of the gap G1.

The present embodiment further fixes the projecting portion 134 to the support member 131 supported so as to be rotatably movable around the drive shaft 129*a* of the third conveying roller 129. The projecting portion 134 has the circular surface 134*a* formed on its end surface and having the center of radius on the axis of the drive shaft 128*a* of the stabilizing roller 128. The circular surface 134*a* has a radius of curvature larger than the radius of the stabilizing roller 128 by an amount corresponding to the gap G1.

Thus, the gap G1 always has a specified value even if the circular surface 134*a* of the projecting portion 134 contacts the document glass board 28 at a deviating position. The above relationship is thus reliably established.

The support member 131 according to the present embodiment is formed of, for example, polyacetal, which has a high slidability. Thus, even if the drive shaft 128*a* rubs against the support member 131 as the stabilizing roller 128 rotates, the drive shaft 128*a* and the support member 131 are unlikely to be worn or heated.

Further, in the present embodiment, the angle θ1 of the entry portion C1 from the read surface 21*a* of the glass plate 21 is about 35 degrees. The angle θ2 of the exit portion C2 from the read surface 21*a* of the glass plate 21 is about 40 degrees. This further stabilizes the behavior of the document D passing through the read position R to improve the quality of the document image read by the reader 22.

The present invention is not limited to the above embodiments. In implementation, the components of the embodiments can be varied without departing from the spirit of the present invention. Further, various inventions can be formed by appropriately combining a plurality of components disclosed in the above embodiments. For example, some of the components shown in the embodiments need not be used. Moreover, components of different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An auto document feeder which loads and feeds a document to a read position provided on a read surface of a reader, the auto document feeder comprising:

a conveying device including a conveying path having the read position, the conveying device conveying the document along the conveying path so that the document passes through the read position, the conveying path including an entry portion to allow the document to reach the read position, and an exit portion to allow the document to leave the read position, the entry portion inclining downwards as it approaches the read surface, and the exit portion inclining upwards as it becomes distant from the read surface, and an inclined angle θ1 of the entry portion to the read surface is smaller than an inclined angle θ2 of the exit portion to the read surface;

a stabilizing roller stabilizing movement of the document conveyed by the conveying device, the stabilizing roller having a drive shaft and provided in the conveying path to be positioned upstream of the read position and opposing to the read surface, a gap between the stabilizing roller and the read surface exceeding the thickness of the document;

a downstream roller located on the exit portion and conveying the document, and having a drive shaft;

a support member which connects the drive shaft of the stabilizing roller and the drive shaft of the downstream roller, the support member supporting the stabilizing roller rotatably around the drive shaft of the downstream roller and having a projecting portion projecting towards the read surface, the projecting portion forming the gap between the read surface and the stabilizing roller; and a guide member guiding the document conveyed by the conveying device, the guide member provided downstream of the read position and opposing to the read surface, a gap between the read surface and the guide member exceeding the gap between the stabilizing roller and the read surface.

2. The auto document feeder according to claim 1, wherein the inclined angle θ1 is about 35 degrees, and the inclined angle θ2 is about 40 degrees.

3. The auto document feeder according to claim 1, further comprising:

an upstream roller located on the entry portion and conveying the document.

4. The auto document feeder according to claim 3, wherein the upstream roller is located upstream of the read position, and the downstream roller is located downstream of the read position.

5. A method of automatically conveying a document conveyed along a conveying path to a read position which is positioned on a read surface of a reader, the method comprising:

allowing the document transferred along the conveying path to enter the read surface by an entry portion which is inclined downwards as it approaches the read surface;

stabilizing movement of the document conveyed on the read surface by a stabilizing roller provided in the conveying path to be positioned upstream of the read position, the stabilizing roller having a drive shaft and opposing to the read surface, a gap between the stabilizing roller and the read surface exceeding the thickness of the document;

guiding the document conveyed on the read surface by a guide member, the guide member provided downstream of the read position and opposing to the read surface, a gap between the read surface and the guide member exceeding the gap between the stabilizing roller and the read surface;

allowing the document passing through the read surface to leave the read surface by an exit portion inclining upwards as it becomes distant from the read surface and a downstream roller located in the exit portion, the downstream roller having a drive shaft, and a leaving angle θ2 of the document to the read surface being greater than an entering angle θ1 of the document to the read surface; and defining the gap between the stabilizing roller and the read surface by a support member connecting the drive shaft of the stabilizing roller and the drive shaft of the downstream roller, the support member supporting the stabilizing roller rotatably around the drive shaft of the downstream roller and having a projecting portion towards the read surface, the projecting portion being brought into contact with the read surface, thereby forming the gap between the read surface and the stabilizing roller.

6. The method according to claim 5, wherein a difference between the entering angle θ1 and the leaving angle θ2 is five degrees.

* * * * *